US006012748A

United States Patent [19]

Franks

[11] Patent Number: 6,012,748

[45] Date of Patent: Jan. 11, 2000

[54] ANIMAL WASTE COLLECTION AND DISPOSAL DEVICE

[76] Inventor: John Franks, 9629 W. 63rd. Pl., Arvada, Colo. 80004

[21] Appl. No.: 08/895,216

[22] Filed: Jul. 16, 1997

[51] Int. Cl.[7] ..... A01K 29/00; E01H 1/12

[52] U.S. Cl. ..... 294/1.4; 294/55

[58] Field of Search ..... 294/1.1, 1.3–1.5, 294/49, 54.5, 55; 15/257.1, 257.3, 257.7; 141/108, 109, 390, 391; 209/417–419

[56] References Cited

U.S. PATENT DOCUMENTS

| | | | |
|---|---|---|---|
| D. 255,951 | 7/1980 | Halls et al. | 294/1.3 |
| D. 333,888 | 3/1993 | Visser . | |
| 456,459 | 7/1891 | Wright et al. | 209/419 |
| 2,183,976 | 12/1939 | Smith | 294/54.5 |
| 3,659,888 | 5/1972 | Dreier | 294/55 X |
| 3,688,483 | 9/1972 | Hamilton . | |
| 3,986,744 | 10/1976 | Krogstad et al. | 294/1.3 |
| 4,149,745 | 4/1979 | Willis | 294/1.4 |
| 4,447,082 | 5/1984 | Lindholm | 294/1.4 |
| 4,986,587 | 1/1991 | Lozano | 294/1.4 |
| 5,039,149 | 8/1991 | Gish . | |
| 5,131,704 | 7/1992 | Li . | |
| 5,320,393 | 6/1994 | Cortinas . | |
| 5,335,952 | 8/1994 | Clapper . | |
| 5,350,208 | 9/1994 | Heinrichson . | |
| 5,482,337 | 1/1996 | Rose . | |
| 5,540,470 | 7/1996 | Lu . | |
| 5,562,319 | 10/1996 | Kohler . | |
| 5,575,520 | 11/1996 | Northcutt | 294/55 |
| 5,580,111 | 12/1996 | Bohn | 294/1.3 |

FOREIGN PATENT DOCUMENTS

| | | | |
|---|---|---|---|
| 48579 | 4/1934 | Denmark | 294/55 |
| 612851 | 11/1948 | United Kingdom | 294/55 |
| 671278 | 4/1952 | United Kingdom | 294/55 |

*Primary Examiner*—Johnny D. Cherry
*Attorney, Agent, or Firm*—Jennifer Stachniak

[57] ABSTRACT

An animal waste collection and disposal device, adapted for use with disposable bags with handles, includes an elongated handle portion and a shovel portion adjustably attached thereto. The shovel portion includes an elongated, open-ended chute portion, a sifting portion extending at an acute angle from the chute and having a plurality of openings for removal of kennel gravel and dirt, and a lifting edge, which preferably includes a plurality of teeth for aiding in lifting the waste out of grass or other uneven terrain, which may extend at a second acute angle from the sifting portion. A pair of sidewalls extend along the longitudinal edges of the shovel portion, thereby preventing the animal waste from falling off of the shovel. The shovel is attached to the handle using a plurality of brackets and retention sleeves. The sleeves may be tightened about the handle, preferably with set screws. For collection of the waste from the shovel, the handles of a disposable bag are looped around one of the set screws and the bag is expanded about the chute portion, and particularly its open end, such that the waste drops into the bag from the chute portion after sliding through the entire length of the shovel.

8 Claims, 3 Drawing Sheets

ANIMAL WASTE COLLECTION AND DISPOSAL DEVICE

BACKGROUND OF THE INVENTION

1. Field of the Invention

The present invention relates generally to devices for picking up animal waste, and more particularly, relates to a device for the hands-free collection of dog or other animal waste and its easy disposal into an attached bag by a single, sweeping motion.

2. Description of the Related Art

Many people enjoy the pleasures associated with owning one or more dogs as pets, such as the companionship, safety, and the love the pet can provide. The pleasures of owning a dog are also accompanied by much responsibility, including feeding, training, and cleaning up after the dog.

Most individuals do not have the luxury of owning vast expanses of property where a dog can run and "do its business" far away from where the owner, and perhaps his or her young children, live and carry on their own activities out of doors. Rather, most individuals live in apartments, condominiums, or homes with limited outdoor areas in which a dog must be trained to urinate and defecate, thus necessitating frequent or often immediate clean up of the dog's feces to keep the area clean for the use of others or the owner's own family. Indeed, in common areas of apartment buildings and condos, as well as in public parks and open spaces, the law may require the dog's owner to pick up after his or her pet immediately, or face a penalty.

This rather unpleasant task is often dealt with by picking up the feces with a plastic glove or bag, or perhaps by scooping up the waste with a shovel and placing it in a bag, a messy and time consuming task if one is faced with cleaning up an entire yard or pen. Further, using one's hands, even if it is encased in a glove or plastic bag, or a shovel poses the risk of getting the feces onto one's skin or clothing, an unsanitary and unpleasant experience for even the most devoted dog owner.

A number of attempts have been made to address these and other problems associated with cleaning up after one's pet by providing various types of devices for scooping up or otherwise disposing of dog feces without using one's hands. For instance, Gish in U.S. Pat. No. 5,039,146 discloses a V-shaped scoop into which a bag may be placed to collect animal feces. However, Gish requires a paddle to push the feces into the scoop device, thus necessitating the use of both hands. Also, it is likely a plastic grocery bag would easily tear in use by its placement around the ground-contacting edges of the scoop portion.

Rose in U.S. Pat. No. 5,482,337 discloses a scoop having a very narrow cup secured to one end of an elongated handle. Again, Rose's device suggests the use of a second implement to scoop the feces into the narrow opening of the cup; Rose fails to include a bag or other containment means for the collected waste. U.S. Pat. No. 5,131,704 to Li shows a similar frame located at an angled end of a handle to which a refuse bag is attached for waste collection. Again, Li's rather small scoop frame suggests difficulty in picking up feces on the ground without the use of another implement, and also requires smaller, specialized collection bags for use with the frame.

Kohler, Heinrichson, Lu, Clapper, and Cortinas in U.S. Pat. Nos. 5,562,319, 5,350,208, 5,540,470, 5,335,953, and 5,320,393, respectively, also describe devices contemplated for use in retrieving and disposing of animal feces. In general, each of these devices includes some type of manually operated switch or level apparatus located at the upper end of an elongated handle, which the user must operate to open and close jaws or similar sections of a scoop portion in order to trap the feces within the scoop. Several suggest the use of a bag or other containment means attached to the device for retention and later disposal of the feces after collection. While these devices eliminate the need for using both hands to collect the feces, they are necessarily heavier by the inclusion of the manually operated switches and levers and more complex operating structure. Further, their generally more complex designs and mechanical parts would require more maintenance and repair and more time spent cleaning the various components after use, and may cost more than a pet owner wishes to spend on such a tool.

Other patents of interest are U.S. Pat. Nos. 3,688,483 and Des. 33,888 to Hamilton and Visser, respectively.

SUMMARY OF THE INVENTION

It is therefore an object of the present invention to provide an animal waste collection and disposal device that provides the user a hands-free method of both picking up and disposing of animal waste.

It is a further object of the present invention to provide such a collection and disposal device which has a simple and lightweight construction.

It is another object of the present invention to provide a collection and disposal device which is also easy to maintain and clean.

It is a further object of the present invention to provide a collection and disposal device which specifically uses and recycles bags for disposal of the feces that are readily available and free of cost to the user, such as plastic grocery bags.

It is yet another object of the present invention to provide a collection and disposal device which is inexpensive and durable.

Yet another object of the present invention is to provide a collection and disposal device which enables the user to pick up animal feces and deposit it into the bag in one easy, sweeping motion, while allowing the user to remain standing in an upright position.

In accordance with the present invention, the preferred form of an animal waste collection and disposal device broadly comprises an elongated handle portion and an angled collection shovel portion. The shovel portion comprises an upper elongated chute portion, an intermediate, perforated sifting portion extending at a first obtuse angle from the chute portion, and a lower flattened lifting portion extending at a second obtuse angle from the intermediate portion. The lifting portion, at one longitudinal end of the shovel, preferably includes a serrated, support-surface contacting edge for use of the device in grass, gravel or other terrain where pick-up might be more difficult. The shovel includes a plurality of U-shaped brackets mounted thereon, each of which includes a sleeve adapted to receive the handle therethrough. A set screw holds the handle in place within the mounting sleeves.

The shovel includes a pair of raised sidewalls running along its length for retention of the feces within the shovel during the scooping and bagging process.

In use, the angled configuration of the shovel allows the user to maintain an upright stance, eliminating the need to bend over at the waist while collecting and bagging the waste materials. The user simply attaches the handles of a standard plastic grocery bag around the upper extending end of one of the set screws, and extends the interior of the bag about the chute portion of the shovel, such that the end opposite the terminal, lifting end of the shovel is surrounded by the interior of the bag. The user then holds the handle at its upper end and applies the lower, terminal lifting edge of the shovel underneath the waste to be collected. By then raising the terminal lifting edge of the shovel, the waste slides from the terminal lifting edge of the shovel onto the intermediate sifting portion, where kennel gravel or dirt may be removed. The waste then slides further back onto the elongated chute portion, where it is quickly directed backward toward the end of the chute and into the disposal bag. The sidewalls and the bag surrounding the chute prevent the waste from sliding from the chute onto the ground or floor.

An obvious advantage to the present invention, other than the simple sweeping, lifting and bagging movement, is that the device is contemplated for use with standard grocery bags, which are often merely thrown away or else stuffed into a pantry or closet. The device provides a useful and convenient method of recycling the bags.

The above and other objects, advantages and features of the present invention will become more readily appreciated and understood from a consideration of the following detailed description of the preferred embodiment of this invention when taken together with the accompanying drawings, in which:

DETAILED DESCRIPTION OF THE PREFERRED EMBODIMENT(S)

Figure 1:
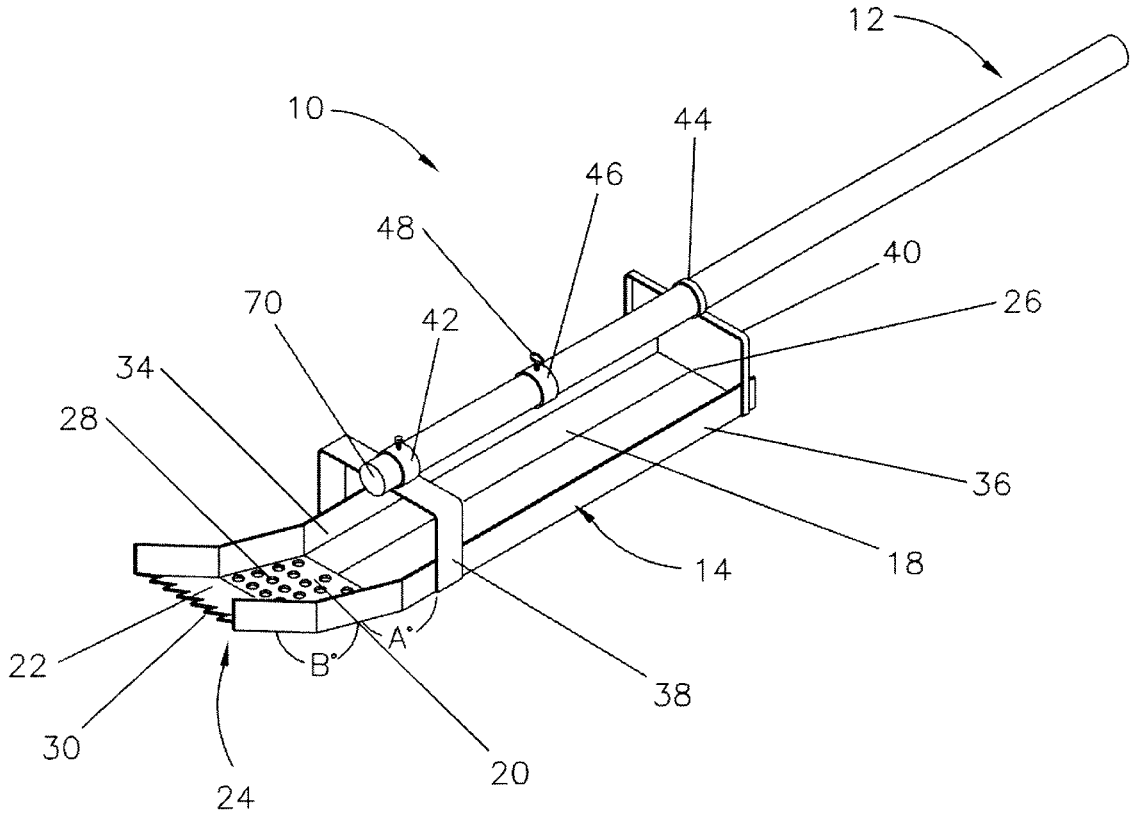
FIG. 1 is a perspective view of the preferred embodiment of the animal waste collection and disposal device of the present invention.

Referring now to the drawings in more detail, FIG. 1 best illustrates a preferred form of the animal waste collection and disposal device of the present invention 10, which comprises an elongated handle portion 12 and an angled collection shovel portion 14 attached thereto. The disposal bag 16, not illustrated in FIG. 1, is shown disposed for attachment to the device in FIG. 2.

Shovel portion 14 is illustrated in FIG. 1 as an integrally constructed, elongated member having opposite longitudinal ends 24, 26 and comprising an upper elongated chute portion 18, an intermediate, perforated sifting portion 20 extending at a first obtuse angle A from the chute portion 18, and a lower flattened lifting portion 22 extending at a second obtuse angle B from the intermediate portion 20. As the nomenclature suggests, the intermediate sifting portion 20 includes a plurality of openings or perforations 28 therethrough for removing additional materials from the collected waste when the device 10 is used in kennel gravel, sand or dirt. The flattened lifting portion 22, disposed at longitudinal end 24, preferably includes a serrated edge 30 for facilitating pick-up of waste in grass, gravel, or other terrain where collection might be more difficult with a straight-edged shovel.

As noted above, the shovel 14 preferably includes two angles A, B disposed where the chute portion 18 terminates into the sifting portion 20 and where the sifting portion 20 terminates into the lifting portion 22, respectively. This specific angled construction of the shovel 14 allows the user to remain standing upright while using the tool, rather than requiring the user to uncomfortably bend over at the waist during the collection and bagging process. Preferably, the first angle A is approximately 108 degrees and the second angle B is approximately 118 degrees, although variations in these measurements could be employed to the same effect.

The shovel portion 14 includes a pair of raised sidewalls 34, 36 running along its longitudinal edges, each preferably one inch high, to prevent the waste from sliding or rolling out of the shovel 14 during collection and bagging.

Figure 2:
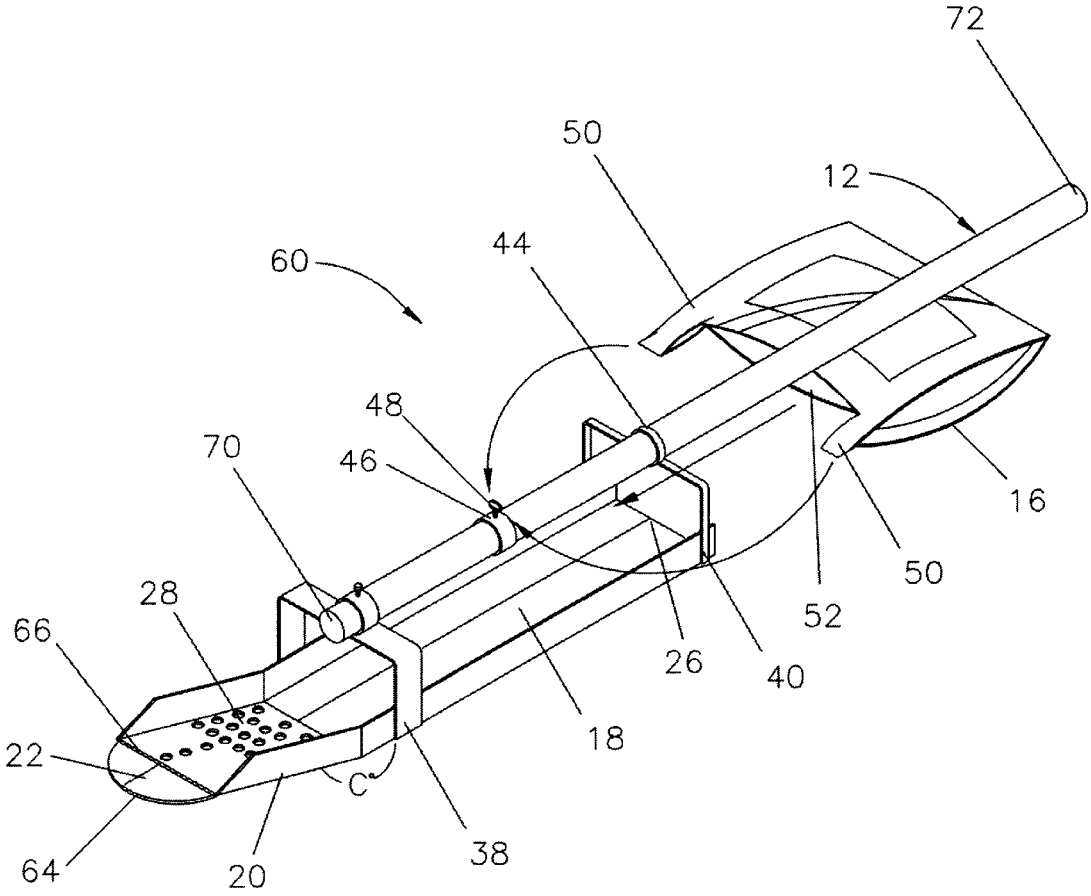
FIG. 2 is a perspective view of a second embodiment of the present invention, illustrating the attachment of a grocery bag for collection and disposal of waste.
Figure 3:
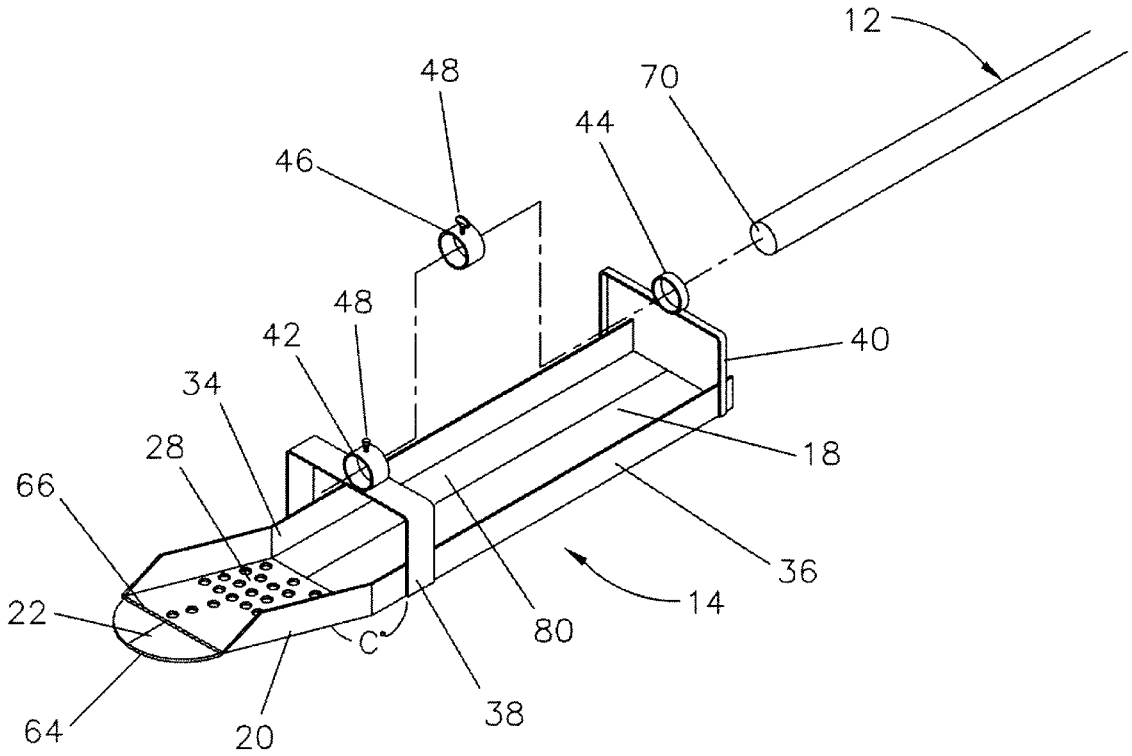
FIG. 3 is a perspective view of the present invention, illustrating the attachment of the handle portion to the shovel portion.

As best shown in FIGS. 1–3, the device 10 includes a separate elongated handle portion 12 having opposite longitudinal ends 70, 72 which is removably attached to the shovel portion 14 in the following manner. At least two U-shaped brackets 38, 40 are secured to the shovel 14 proximate the longitudinal end 26 and on the chute portion 18 proximate the first angle A. Each bracket 38, 40 includes a preferably circular sleeve 42, 44, adapted to receive the handle 12 therethrough. A third sleeve 46 is disposed along the handle 12 approximately midway between the first and second sleeves 42, 44. Preferably, first and third sleeves 42, 46 include a set screw 48 for tightening against the handle 12 and maintaining the handle 12 in place in its attachment to the shovel 14.

The set screw 48 also serves as an attachment point for the disposal bag 16, as best shown in FIG. 2. The invention contemplates the use of the standard plastic grocery bags which have a pair of handles 50, thus providing a convenient and inexpensive method of recycling these bags. The opening 52 of bag 16 is placed about longitudinal end 26 and pulled downwardly to extend about halfway down the chute portion 18. The handles 50 are looped over one of the set screws 48. The bag 16 is then expanded about the chute portion 18, such that the bag 16 covers the upper half of the chute portion 18 and hangs somewhat therefrom.

FIGS. 2 and 3 depict a slightly modified form of the present invention 60, wherein the shovel portion 14 has only one angle C, preferably about 118 degrees, along its length, which is disposed between the chute portion 18 and the sifting portion 20. The lifting edge 22 extends from the sifting portion 20, and has a more rounded edge 64. A collection dam 66, or a raised ridge, is disposed between sifting portion 20 and the lifting portion 22 for preventing the waste from sliding or rolling back off the edge 64. The handle 12 is attached to the shovel 14 is the same manner as above described.

Preferably, the shovel portion 14 is approximately 24 inches in length and about 5 inches wide, while the handle 12 is approximately 48 inches in length and preferably has a round configuration with a 1 to 1.5 inch diameter. It is contemplated that both the handle 12 and the shovel 14 are constructed of a lightweight, yet durable, plastic, although both could be constructed of steel, aluminum or similar metals, preferably having a lighter weight, for easier use of the device. The invention also contemplates the use of a slick coating, such as Teflon or even cooking oil on the upper surface 80 of the shovel 14 to facilitate movement of the waste along the shovel 14 and into the bag 16.

In use, the handle 12 is grasped proximate longitudinal end 70 and the lower, lifting edge 22 placed under the waste to be collected. The waste is then simply lifted up by the user's applying a lever-like motion to the upper end of the handle. The waste then slides along the shovel 14, passing over the sifting portion 20 to allow other materials, such as kennel gravel or dirt, to be removed therefrom, and slides down through the chute portion 18 and into the attached disposal bag 16 which is extended over the longitudinal end 26 of the chute 18. The device 10 can be used as many times as needed until it is necessary to change and dispose of the bag 16.

It is therefore to be understood that while a preferred form of an animal waste collection and disposal device has been herein set forth and described, various modifications and changes may be made in the construction and arrangement of parts as well as composition of materials without departing from the spirit and scope of the present invention as defined by the appended claims.

I claim:

1. An animal waste collection and disposal device for use with a disposal bag with handles, comprising:

an elongated handle portion;

a shovel portion having upper and lower surfaces, said shovel portion including an elongated chute portion having an open longitudinal end, a sifting portion extending from said chute portion, said sifting portion having a plurality of openings therethrough, and a lifting portion extending from said sifting portion, said lifting portion including a terminal edge with serrated teeth;

means for attaching said handle portion to said shovel portion, said means including at least one attachment bracket, each bracket having at least one retaining sleeve adapted to receive said handle portion therethrough, each said sleeve including means for tightening said sleeve about said handle portion, said handles of said disposal bag attachable about said tightening means for expansion of said bag about said open end of said chute portion; and a pair of sidewalls extending along longitudinal edges of said shovel portion for retention of said animal waste within said shovel portion.

2. An animal waste collection and disposal device according to claim 1 wherein said handle and said shovel portions are made of a material selected from the group consisting of lightweight plastics and lightweight metals.

3. An animal waste collection and disposal device according to claim 1 wherein said upper surface includes a nonstick coating substance for easy movement of said animal waste along said upper surface of said shovel portion.

4. An animal waste collection and disposal device for use with a disposal bag, comprising:

an elongated handle portion having opposite longitudinal ends;

an elongated shovel portion attached proximate one end of said handle portion, said shovel portion having opposite, open longitudinal ends and a plurality of openings therethrough;

a pair of sidewalls extending along said longitudinal edges of said shovel portion; and means for attaching said handle portion to said shovel portion, said attachment means including at least one U-shaped bracket secured to said shovel portion, each said bracket having a sleeve adapted to receive said handle portion therethrough and including means for tightening said sleeve about said handle portion, said disposal bag attachable about said attachment means for expansion and extension about one of said open longitudinal ends of said shovel portion.

5. An animal waste collection and disposal device according to claim 4 wherein said shovel portion includes an elongated chute portion having an open end, said chute portion extending into a sifting portion, said sifting portion including said plurality of openings and extending into a lifting portion disposed at one longituinal end of said shovel portion.

6. An animal waste collection and dipsosal device according to claim 5 wherein said lifting portion has a serrated terminal edge.

7. An animal waste collection and disposal device according to claim 5 wherein said lifting portion has a rounded terminal edge and wherein said shovel portion includes a retention ridge disposed between said sifitng and said lifting portions.

8. An animal waste collection and disposal device according to claim 4 wherein said shovel portion inclues upper and lower surfaces, said upper surface having a nonstick coating substance for easy movement of said animal waste on said shovel portion.

* * * * *